US005401548A

United States Patent [19]

Stepanek

[11] Patent Number: 5,401,548

[45] Date of Patent: Mar. 28, 1995

[54] ADHERING CEREMONIAL ROLL

[75] Inventor: Michael J. Stepanek, Hollis, N.H.

[73] Assignee: Hampshire Paper Corp., Milford, N.H.

[21] Appl. No.: 144,333

[22] Filed: Nov. 1, 1993

Related U.S. Application Data

[63] Continuation-in-part of Ser. No. 954,027, Sep. 30, 1992, abandoned.

[51] Int. Cl.[6] ..... D04D 9/00

[52] U.S. Cl. ..... 428/40; 150/154; 428/194; 428/214; 428/215; 428/220; 428/224; 428/343; 428/354; 428/355; 428/906; 206/389; 206/411

[58] Field of Search ..... 428/40, 906, 343, 355, 428/354, 194, 214, 215, 220, 224, 85; 206/389, 411; 108/90; 150/154

[56] References Cited

U.S. PATENT DOCUMENTS

| | | | |
|---|---|---|---|
| 2,618,333 | 11/1952 | Judd | 428/194 |
| 3,752,304 | 8/1973 | Alef | 428/194 |
| 4,599,265 | 7/1986 | Esmay | 428/355 |
| 4,826,712 | 5/1989 | Theno | 428/906 |
| 5,066,529 | 11/1991 | Huber | 428/40 |

*Primary Examiner*—Nasser Ahmad

*Attorney, Agent, or Firm*—White, Stephen; Bourque: Daniel J.

[57] ABSTRACT

A ceremonial roll of material that can be easily unrolled and used is described. The roll contains a small layer or strip of releasable adhesive located on the floor surface of the roll at the starting end thereof. The adhesive is applied to the roll under pressure and at elevated temperatures. This adhesive is then pressed onto the floor itself before the roll is rolled down the aisle or walkway to be used. The adhesive will hold to the floor during the unrolling but can easily be removed by pulling up at an angle of greater than 30° from the floor. The adhesive will resist from 10 to 300 pounds of pull at angles less than this 30°. The ceremonial roll may be made from a host of materials but a non-woven material made from long, natural and synthetic fibers is preferred.

8 Claims, 1 Drawing Sheet

ADHERING CEREMONIAL ROLL

This invention is a continuation-in-part of my application U.S. Ser. No. 07/954,027, filed Sep. 30 1992, now abandoned.

BACKGROUND OF THE INVENTION

1. Field of the Invention

This invention relates to ceremonial rolls of material, e.g. non-woven fabric, plastic and the like. Specifically, this invention relates to ceremonial rolls of material used to line an aisle or walkway. Even more specifically, this invention relates to ceremonial rolls of material that can be conveniently laid on said aisle or said walkway and which contain a removable tape or line of adhesive to permit easy setting and removing of said roll from said aisle or said walkway.

2. Description of the Prior Art

The concept of using some sort of runner to put down in an aisle or walkway just before a ceremonial event, is well-known in the prior art. Such runners are used when dignitaries arrive for some sort of function. More specifically, such runners are commonly used during the wedding ceremony and are placed in the aisle of a church, synagogue or some other place where a wedding is about to take place. The dignitary or bride and the parties associated therewith then walk down on the runner. Sometimes, these runners are made of cloth or other fabric and sometimes they are made from plastic and the like. These materials must be strong enough to resist damage due to walking and yet light enough to allow quick and easy use.

These ceremonial events usually require that the roll be laid down just prior to use and assistants present usually place one end of the roll at the point where the users will start and then roll the remainder down the aisle or walkway. When a roll of non-woven material is used, it is conventional for the assistants to have the roll on a rope so that it can be unrolled very easily. During weddings, for example, the ushers, attendants or others from the wedding party have a roll of white non-woven material or plastic. In the center, core of the roll, a decorative rope is usually threaded. The attendants place the start of the roll at the point where the bride will begin her walk down the aisle to that point where the wedding ceremony takes place. They pull this roll down this aisle or walkway to cover the walking surface with the material contained on the roll. The bride then enters and walks on the covered aisle to participate in the wedding ceremony. All of this adds beauty, pomp and circumstance to this ceremony. Many of these rolls of material are embossed or otherwise decorated to add beauty to the surface thereof. Sometimes these rolls are unrolled right along the floor and sometimes they are held just above the floor at an angle thereto just prior to being unrolled.

There are, however, problems with the un-rolling of this ceremonial walkway cover. Since the material is light, there is a tendency that it will not lie properly on the floor of the walkway. Usually, one of the attendants is forced to stand on the beginning of the roll to insure that it does not trail after those who are unrolling same. If there is a slight breeze that occurs when a door opens, for example, there is also a tendency for this unrolled material to be ruffled up by this breeze to become wrinkled and unsightly. Usually, there is a scramble by the attendants to insure that this walkway remains covered in a neat and straight manner by the ceremonial roll of material. This scrambling detracts from the main reason for this ceremony and presents serious problems.

The use of adhesives and the like to attach materials to floors and the like are well-known. The use of double-side coated tapes to hold down carpets is an example of this use. Most of these adhesives tend to stick permanently or at least semi-permanently to the floor in order to hold the carpet in a firm position over a long period of time. When these materials are removed, much of the adhesive remains on the floor and must be removed by the use of solvents or by scraping.

The use of temporary adhesives for various and sundry purposes is also well-known. Most of these uses involve decorative ribbons for packaging; temporary material for posting notes and the like; sheets of drafting paper; among many others. These temporary adhesives are of the tack/release type well-known in the prior art. They are designed to provide a temporary tackiness to the material on which they are applied. Most of these tack materials will not withstand a hard pull during use.

There is a long-standing need to provide a ceremonial roll of material with some sort of glue or adhesive that will hold the roll in place during unrolling and during use and yet which can be easily removed from the floor surface without damage either to the floor or to the roll itself.

SUMMARY OF THE INVENTION

It is an object of this invention to provide a ceremonial roll of material used to cover a walkway or an aisle during such a ceremony. It is yet another object of this invention to provide this ceremonial roll with sufficient tack-release adhesive to allow for adequate adhesion during use but which can be easily removed after such use. Finally, it is a specific object of this invention to provide a non-woven material roll used to cover the aisle during a wedding wherein said roll contains sufficient adhesive at the starting end thereof and to permit the unrolling of the roll and to withstand such force as is required therefor. These and yet other objects are achieved in a ceremonial roll of material designed to be rolled down a walk way, said roll having a length defined by a starting point, and an ending point, a walking surface and a floor surface, and a width, wherein at least the starting point of said roll has a releasable, double-side coated, pressure sensitive adhesive layer applied to the floor surface thereof and wherein when said adhesive is applied from said roll to said walkway and wherein said roll is unrolled at an angle of between 0° and 30° from said walk way, said adhesive will withstand a pull of between 10 to 300 pounds of pull without being removed from said roll or said walk way.

In yet another embodiment this invention relates to a process for applying an adhesive tape to a ceremonial roll of material comprising the steps of applying said adhesive tape to said roll of material at an operating temperature of from 120° to 175° F. and a pressure of 35 to 80 psi for 5 to 10 seconds.

DETAILS OF THE INVENTION

Figure 1:
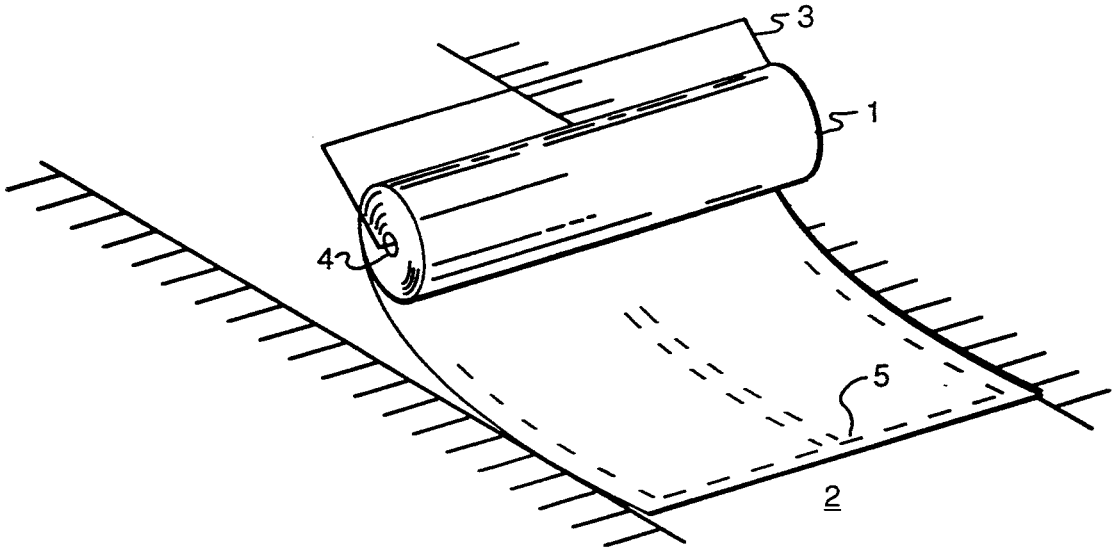
FIG. 1 is a showing of a typical ceremonial roll of material being unrolled down an aisle or walkway.

Ceremonial rolls of material used to cover aisles and walkways prior to the onset of the desired ceremony are legion in number. Most of these are prepared from a non-woven material (e.g. non-woven fabrics, plastic sheeting and the like). These materials can be manufactured in a myriad of colors and can be decoratively embossed. In most cases, these rolls are discarded after use, especially if particularly soiled. There are a number of other materials used to make such ceremonial rolls including very thin polymeric plastics such as polyethylene, for example. Additionally, these rolls may be made entirely of non-woven cloth or fabric. By non-woven materials I mean a fabric-like material made by combining long, natural and synthetic fibers for strength, light weight and controlled porosity by unique and proprietary bonding methods, chemical treatments and softening processes which also add to the strength and softness quality of this material. The presence of synthetic and natural fibers vs. cellulosic fibers in this material is what differentiates non-woven material from paper.

During use, the roll of material is unrolled down the aisle or walkway over which the bride or dignitary will walk. Since these materials are often flimsy, they tend to unroll with difficulty and will not stay in the desired location. It is common for members of the wedding party or other attendants to try and hold the roll down whilst it is being unrolled. This is not a desired action as many attendants or assistants are required for this step. This invention solves many of these problems by providing a small layer of removable adhesive to the floor surface of the ceremonial roll at the starting end thereof. Alternatively, the layer of removable adhesive may be applied on the sides of the floor abutting surface of the roll or down the middle of the walking surface or some other useful place to insure that the roll stays down during unrolling. The attendants or assistants simply press this layer on the floor and then can conveniently and easily unroll the roll down the aisle or walkway. The adhesive, however, must hold the roll firmly to the floor during the unrolling step but must be easily removed after the ceremony so that the floor does not become damaged by the presence of excess adhesive. Additionally, the adhesive must resist the force of pull on the ceremonial roll without being dislodged from said roll. Since there are many different types of floors finding the correct adhesive for each type of floor is a time consuming process. What I have found in this invention that if the adhesive is applied to the ceremonial roll by a particular method or process, both steps outlined above will be solved. The adhesive will adhere strongly to the roll during application and will also adhere to any floor surface during application yet can be easily removed later.

A normal walk way, such as an aisle or passage way will be from about 20 inches to about 55 inches in width, with 20 inches to about 40 inches being normal, average walk way width. We prefer that the ceremonial rolls of this invention fit within the metes and bounds of the normal walk way and thus the roll width can be within these specifications. A most preferred walk way width and ceremonial roll width is 36 inches.

The ceremonial rolls of this invention may be undecorated or decorated, e.g. embossed with a pattern or having a printed pattern thereon. A particularly preferred ceremonial roll will have decorative pattern embossed on the surface thereof, with the decorative pattern matching the ceremony involved.

Referring now specifically to the drawings, FIG. 1 shows a typical ceremonial roll of material 1 being laid on an aisle 2. The roll is being pulled by a rope 3 which is strung through a core 4. A typical adhesive has been applied to the floor surface of the roll and this is shown by a dotted line 5.

Figure 2:
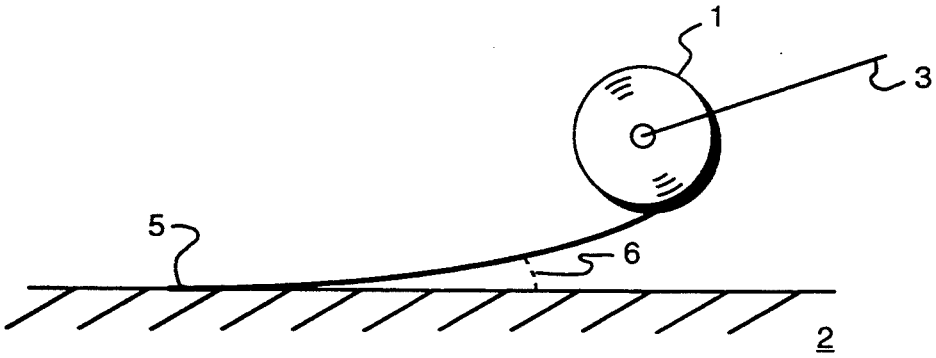
FIG. 2 is a side view showing of the roll of FIG. 1 demonstrating the angles at which said roll of material can be unrolled to cover said aisle or walkway.

FIG. 2 is a side view of the roll 1. In this showing, the rope 3 is pulling roll 1 at an angle 6. This angle can be varied from 0° to 30° without affecting release of the glue at 5.

A number of different types of adhesives can be used within the metes and bounds of this invention. These adhesives include, among others, the following:

| Composition | Manufacturer |
|---|---|
| Acrylic Paper Tape | Permacel TM #5033X Double Coated Tape, 3M Corp., Minneapolis, MN. |
| Acrylic Tape | #465, 3M Corp., Minneapolis, MN. |
| Double Coated Tape | #410, 3M Corp., Minneapolis, MN. |
| Acrylic Adhesive (Economy Grade Splicing Tape) | tesa 7003, tti tesa tuck Inc., Sparta, mi. |
| Acrylic Adhesive (Corrugator Splicing Tape) | tesa 7158, tti tesa tuck Inc., Sparta, mi. |
| Acrylic Adhesive (Premium Grade Splicing Tape) | tesa 4900, tti tesa tuck, Inc., Sparta, mi. |
| Acrylic Adhesive (Light Duty Ass. Tape) | tesa 4900 PV9, tti tesa tuck, Inc., S Sparta, Mi. |
| Rubber Resin (General Purpose Mounting & Joining Tape) | tesa 4903, tti tesa tuck, Inc., Sparta, mi. |
| Acrylic Adhesive (General Purpose Affixing, Joining & Splicing Tape) | tesa 4959, tti tesa tuck, Inc., Sparta, mi. |

Although many glues are known in the prior art and many have been described as releasable, the process of application of the glue on the floor surface of the ceremonial roll of material is very important. It is this process which provides the requisite adherence to the roll and any of the conventional floor surfaces during use yet permits the removal of the glued roll after use. This removal can easily be accomplished by pulling the roll at a force of between 10 and 300 pounds of pull at an angle of greater than 30° from the floor surface. Sometimes, when the ceremonial roll is semi-transparent, for example, it is required that the adhesive layer itself be transparent so as not to be observable during the ceremony. This can be accomplished by applying the adhesive layer in a thin but wide strip across the end of the roll on the floor surface thereof. If, however, the roll is not transparent in nature, a thicker and narrower strip of adhesive can be applied to function in the same manner. I prefer that the ceremonial roll be a non-woven material containing cloth or fabric fibers therein and that the adhesive be applied as a ½ inch to 2 inch wide strip (1.5 inch particularly preferred). The adhesive can be applied at a coating thickness of between 1 to 6 mils (prefer 4 mils).

In a specific application and process of this invention, the release-type adhesive is applied to a non-woven material runner as a tape or strip of the adhesive. This application involves imbedding the adhesive into the floor surface of the material at the starting end by heating and laminating the adhesive under pressure. The adhesive material is applied at a pressure of between 35 to 80 psi and at a temperature of between 120° to 175° F.

The time for this process is between 3 to 15 seconds. I prefer to apply the adhesive at 75 psi, 150° F. for 5 to 10 seconds. A strip of releasable paper can then be applied over the adhesive so that the non-woven material can be rolled without interference from the adhesive layer, in fact it is so preferred. When the roll is to be used in a ceremony, for example, the releasable paper is simply stripped off, the end of the roll containing the adhesive layer is then placed down firmly on the floor surface and the roll is un-rolled. This adhesive layer, applied as described herein and used in this manner, will hold this end of the roll in place while the roll is being un-rolled without being stripped from the material itself. Additionally, this end of the roll can be easily stripped from any conventional flooring without leaving traces of glue thereon. This is extremely important since many areas where ceremonial functions are held have expensive flooring in place. This is particularly true in churches, synagogues and the like. The application of a non-removable glue left on the decorative floors of these institutions would be highly undesirable.

In un-rolling the ceremonial roll, it is conventional to pull the roll down the aisle or walkway just prior to the entry of the celebrants or dignitaries. This can be accomplished in a number of ways. During weddings and the like, the roll is carried by a decorative rope which is threaded through the core of the roll. The roll may be simply dragged along the floor at an angle of 0° or it may be lifted up somewhat to accomplish the same effect. In any case, the glue should not be detached from the floor even if the roll is lifted to a 30° angle from the floor during this step. When the ceremony or service is over, the ceremonial roll can be easily stripped from the floor by lifting the end attached to the floor by the adhesive at an angle greater than 30°. For example, grasping the roll near the adhesive end and pulling straight up at 90° and a force of between 10 to 300 pounds will effect complete release from the floor without stripping the glue from the roll itself.

I claim:

1. A ceremonial covering for a walkway, comprising:

a roll of non-woven fabric excluding paper, having a width and including a starting end, a walking surface and a floor abutting surface;

at least a portion of said width of said floor abutting surface at said starting end of said roll including a releasable, double-sided, pressure sensitive adhesive layer, said releasable, double-sided, pressure sensitive adhesive layer extending from said starting end of said floor abutting surface of said roll a distance of between ½ to 2 inches; and wherein a first side of said double-sided pressure sensitive adhesive layer is applied to said floor abutting surface of said roll, and wherein a second side of said double-sided pressure sensitive adhesive layer is covered by a releasable strip of material, thus forming a ceremonial covering for a walkway with a pressure sensitive adhesive layer at said starting end of said ceremonial covering, for allowing said second side of said doublesided, pressure sensitive, adhesive layer to be applied to said walkway, for releasably maintaining said starting end of said roll in contact with said walkway, and for allowing said starting end of said roll to be removed from contact with said walkway by positioning said starting end of said roll at an angle relative to said walkway, and by applying a force to said roll.

2. The roll of claim 1 wherein said releasable, double-sided, pressure sensitive adhesive layer is applied to the floor abutting surface of said roll in a strip of between ½ to 2 inches in width and 1 to 6 mils in thickness.

3. The roll of claim 1 wherein said roll is decoratively embossed.

4. The roll of claim 1 wherein said width is between 20 inches and 55 inches.

5. The roll of claim 1 wherein said angle is between 0 degrees and 30 degrees.

6. The roll of claim 5 wherein said force is between 10 and 300 pounds of pull.

7. A ceremonial covering for a walkway, comprising:

a roll of non-woven fabric excluding paper having a width of between 20 inches and 55 inches and including a starting end, a walking surface and a floor abutting surface;

at least a portion of said width of said floor abutting surface of said starting end of said roll including a releasable, double-sided, pressure sensitive adhesive layer, said releasable, double-sided, pressure sensitive adhesive layer extending from said starting end of said floor abutting surface of said roll a distance of between ½ to 2 inches; and wherein a first side of said double-sided, pressure sensitive adhesive layer is applied to said floor abutting surface of said roll, and wherein a second side is covered by a double-sided, pressure sensitive adhesive layer is covered by a releasable strip of material, thus forming ceremonial covering for a walkway with a pressure sensitive adhesive layer at said starting end of said ceremonial covering, for allowing said second side of said double-sided, pressure sensitive, adhesive layer to be applied to said walkway, for releasably maintaining said starting end of said roll in contact with said walkway, and for allowing said starting end of said roll to be removed from contact with said walkway by positioning said starting end of said roll at an angle of between 0 degrees and 30 degrees relative to said walkway, and by applying a force of between 10 and 300 pounds of pull to said roll.

8. A ceremonial covering for a walkway comprising:

a roll of non-woven fabric excluding paper, including a core region proximate which is attached a ceremonial roll unroller, said roll of non-woven fabric having a width and including a starting end, a walking surface and a floor abutting surface;

at least a portion of said width of said floor abutting surface at said starting end of said roll including a releasable, double-sided, pressure sensitive adhesive layer, said releasable, double-sided, pressure sensitive adhesive layer extending from said starting end of said floor abutting surface of said roll a distance of between ½ to 2 inches; and wherein a first side of said double-sided pressure sensitive adhesive layer is applied to said floor abutting surface of said roll, and wherein a second side of said double-sided pressure sensitive adhesive layer is covered by a releasable strip of material, thus forming a ceremonial covering for a walkway including a ceremonial roll unroller, and pressure sensitive adhesive layer at said starting end of said ceremonial covering, for allowing said second side of said double-sided, pressure sensitive, adhesive layer to be applied to said walkway, for releasably maintaining said starting end of said roll in contact with said walkway, and for allowing said starting end of said roll to be removed from contact with said walkway by positioning said starting end of said roll at an angle relative to said walkway, and by applying a force to said roll.

* * * * *